US011759846B2

(12) United States Patent
Dohr et al.

(10) Patent No.: US 11,759,846 B2
(45) Date of Patent: Sep. 19, 2023

(54) METHOD FOR PRODUCING A POLYGONAL SHAFT

(71) Applicant: MAGNA Powertrain GmbH & Co KG, Lannach (AT)

(72) Inventors: Ewald Dohr, St. Michael (AT); Helmut Haas, St. Peter a. Ottersbach (AT)

(73) Assignee: MAGNA POWERTRAIN GMBH & CO KG, Lannach (AT)

( * ) Notice: Subject to any disclaimer, the term of this patent is extended or adjusted under 35 U.S.C. 154(b) by 50 days.

(21) Appl. No.: 17/707,180

(22) Filed: Mar. 29, 2022

(65) Prior Publication Data

US 2022/0314303 A1 Oct. 6, 2022

(30) Foreign Application Priority Data

Apr. 6, 2021 (DE) ..... 10 2021 203 374.1

(51) Int. Cl.

| | |
|---|---|
| ***B21K 1/12*** | (2006.01) |
| ***B21J 7/16*** | (2006.01) |
| ***B21K 1/06*** | (2006.01) |

(52) U.S. Cl.
CPC *B21K 1/12* (2013.01); *B21J 7/16* (2013.01); *B21K 1/063* (2013.01)

(58) Field of Classification Search
CPC ..... B21J 7/12; B21J 7/14; B21J 7/145; B21J 7/16; B21K 1/063; B21K 1/12
See application file for complete search history.

(56) References Cited

U.S. PATENT DOCUMENTS

| | | | | |
|---|---|---|---|---|
| 6,094,962 | A * | 8/2000 | Eisentraut | B21J 7/16 72/403 |
| 2021/0270154 | A1* | 9/2021 | Kunitake | B21J 7/16 |

FOREIGN PATENT DOCUMENTS

| | | | |
|---|---|---|---|
| DE | 69317757 | T2 | 7/1988 |
| DE | 102013219310 | A1 | 3/2015 |

* cited by examiner

*Primary Examiner* — Debra M Sullivan
(74) *Attorney, Agent, or Firm* — Dickinson Wright PLLC

(57) ABSTRACT

A method for producing a shaft, which is at least partially not circular in cross-section, from a substantially cylindrical blank by means of radial forging, wherein the blank is not rotated in a final radial forging process.

20 Claims, 12 Drawing Sheets

METHOD FOR PRODUCING A POLYGONAL SHAFT

CROSS-REFERENCE TO RELATED APPLICATIONS

This application claims priority to German Patent Application No. DE 10 2021 203 374.1, filed on Apr. 6, 2021 at the German Patent Office which is hereby incorporated by reference in its entirety.

FIELD OF THE INVENTION

The present invention is directed to a method for producing a shaft, which is at least partially not circular in cross-section, from a substantially cylindrical blank by means of radial forging, wherein the blank is not rotated in a final radial forging process.

BACKGROUND OF THE INVENTION

This section provides information related to the present disclosure which is not necessarily prior art.

In the field of machine construction, in particular automotive technology, shafts and axles are central elements. For reasons of weight reduction and resource protection, shafts and axles are increasingly being made from hollow material, for example from tubular blanks as an economic raw material. For example, radial forging processes are used to form the blanks.

A method for hot forging a seamless hollow member made from a material which is difficult to form, in particular from steel, is known from DE 10 2013 219 310 A1. In order to produce a seamless, hot-processed metallic hollow member by hot forging it is proposed that the hot forging takes place by way of a degree of deformation ln(A0/A1) which in terms of the cross section to be formed in the forged portion is less than 1.5 and at a method-related deformation rate of less than 5/s, wherein A0 is defined as the local cross-sectional area in m2 of a hollow member to be forged, and A1 is defined as the local cross-sectional area in m2 of the finished hollow member, and the deformation rate is defined as the maximum velocity in m/s of the hollow member to be forged in terms of the external diameter in m of the completely forged hollow member.

A method for radially forging a blank is known from DE 693 17 757 T2, in which the blank is placed in the manipulator head which is compressed by at least two pairs of press block heads assembled so as to be opposite one another while simultaneously the normal compression force of said pairs of press block heads and a shear force T are then moved along the longitudinal axis, or rotated about the longitudinal axis and moved along the same longitudinal axis.

SUMMARY OF THE INVENTION

This section provides a general summary of the disclosure, and is not a comprehensive disclosure of its full scope or all of its features.

It is an object of the invention to provide a simple method for production of a shaft which is at least partially not circular in cross-section.

This object may be achieved by the subject of the present invention according to the present disclosure, including a method for producing a shaft, which is at least partially not circular in cross-section, from a substantially cylindrical blank by means of radial forging, wherein the blank has shaft portions which are each round forged with the blank rotating, wherein at least one shaft portion is not rotated in an additional final radial forging process. Advantageous embodiments of the present invention are described herein.

The method according to the invention serves for producing a shaft, which is at least partially not circular in cross-section, namely preferably partially polygonal on its outer periphery, from a substantially cylindrical blank by means of radial forging.

According to the present invention, the blank is not rotated in a final radial forging process.

The blank may be a tube open at both ends or an extruded blank closed at one end.

In accordance with a preferable but non-limiting embodiment of the invention, the method comprises at least the following further steps temporally preceding the final radial forging process: provision of a substantially cylindrical blank; and radial forging of at least one shaft portion with the blank rotating.

In the context of the invention, a "final radial forging process" may mean a final forging process which temporally follows preceding forging processes, but also an individual forging process without the blank having previously undergone a forging process.

The present method according to the invention allows, in simple fashion, the possibility of implementing complex external geometries, namely polygonal shapes, of a shaft. Furthermore, a component design close to the final contour can be achieved and thereby a cost saving due to a reduction in mechanical reworking.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION OF THE INVENTION

An exemplary radial forging process is described below with reference to FIG. 5 to FIG. 10, during which a shaft 8 is produced which is partially polygonal on the outer periphery. FIG. 1 to FIG. 4 show individual steps of forming the blank 1 or shaft 8.

Figure 1:
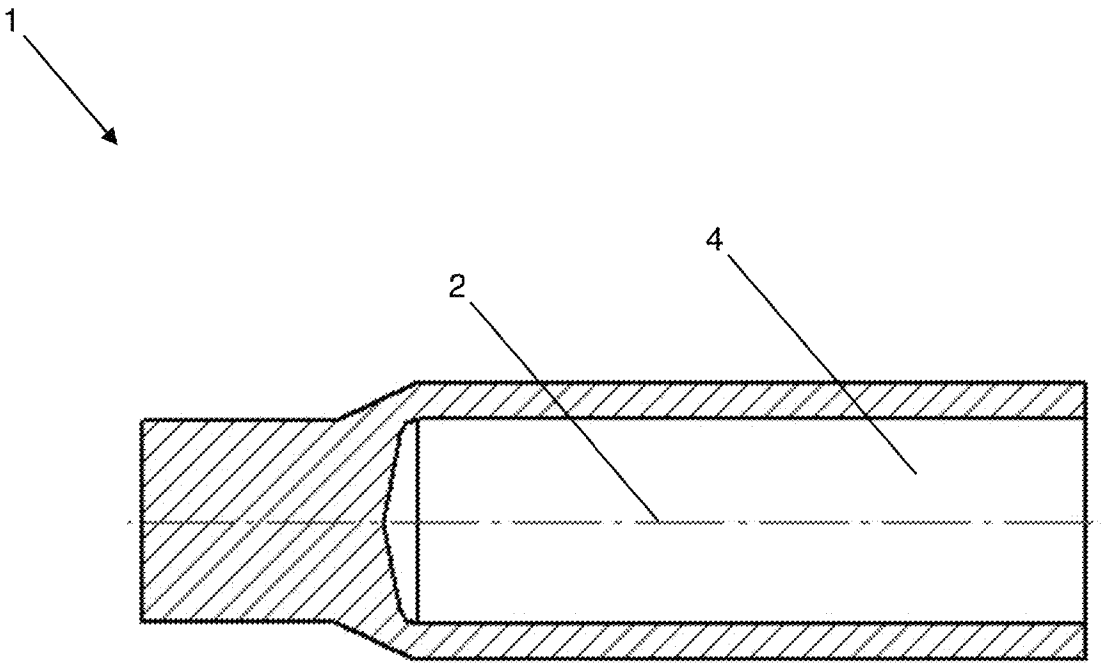
FIG. 1 shows a schematic illustration of an exemplary blank before a forging process.
Figure 2:
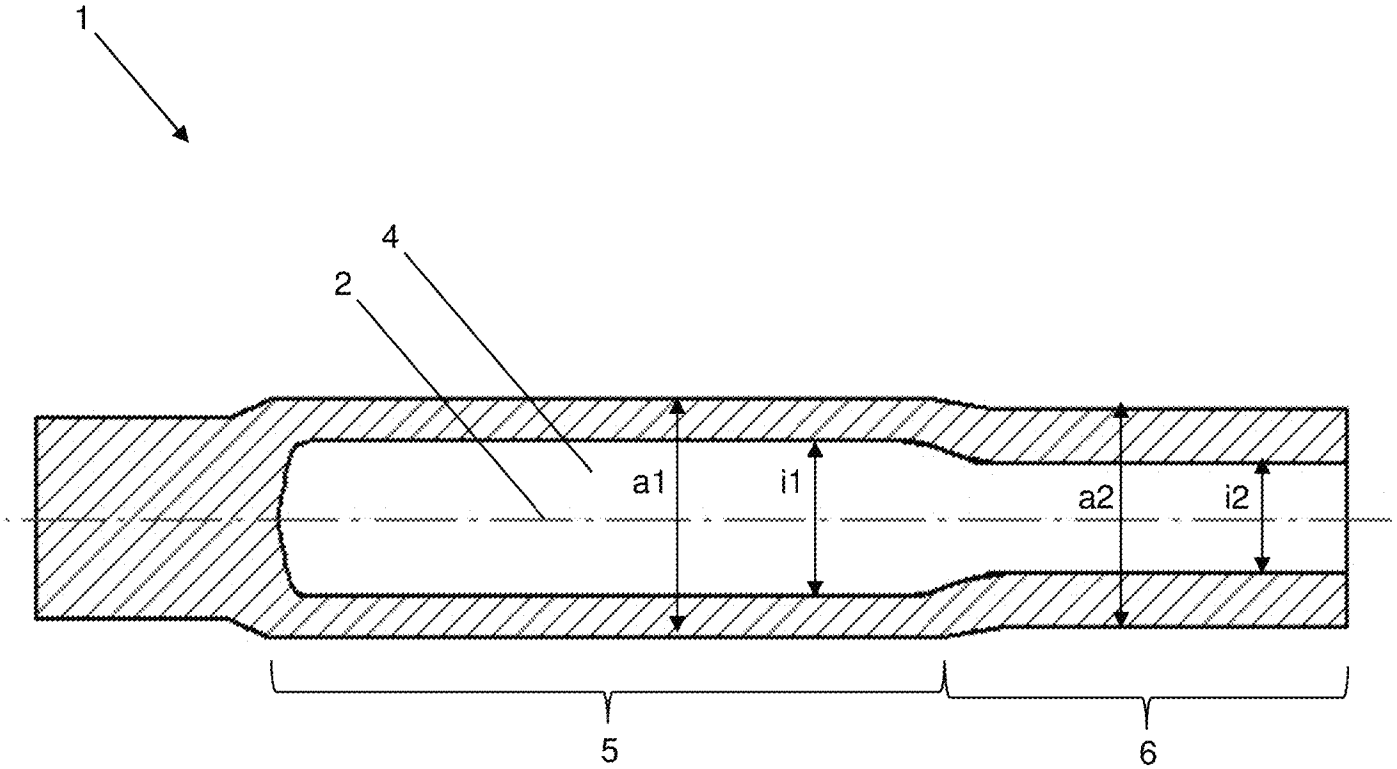
FIG. 2 shows a schematic illustration of an exemplary blank according to FIG. 1 after a first and a second forging process, with a first and second inner diameter and a first and second outer diameter.
Figure 3:
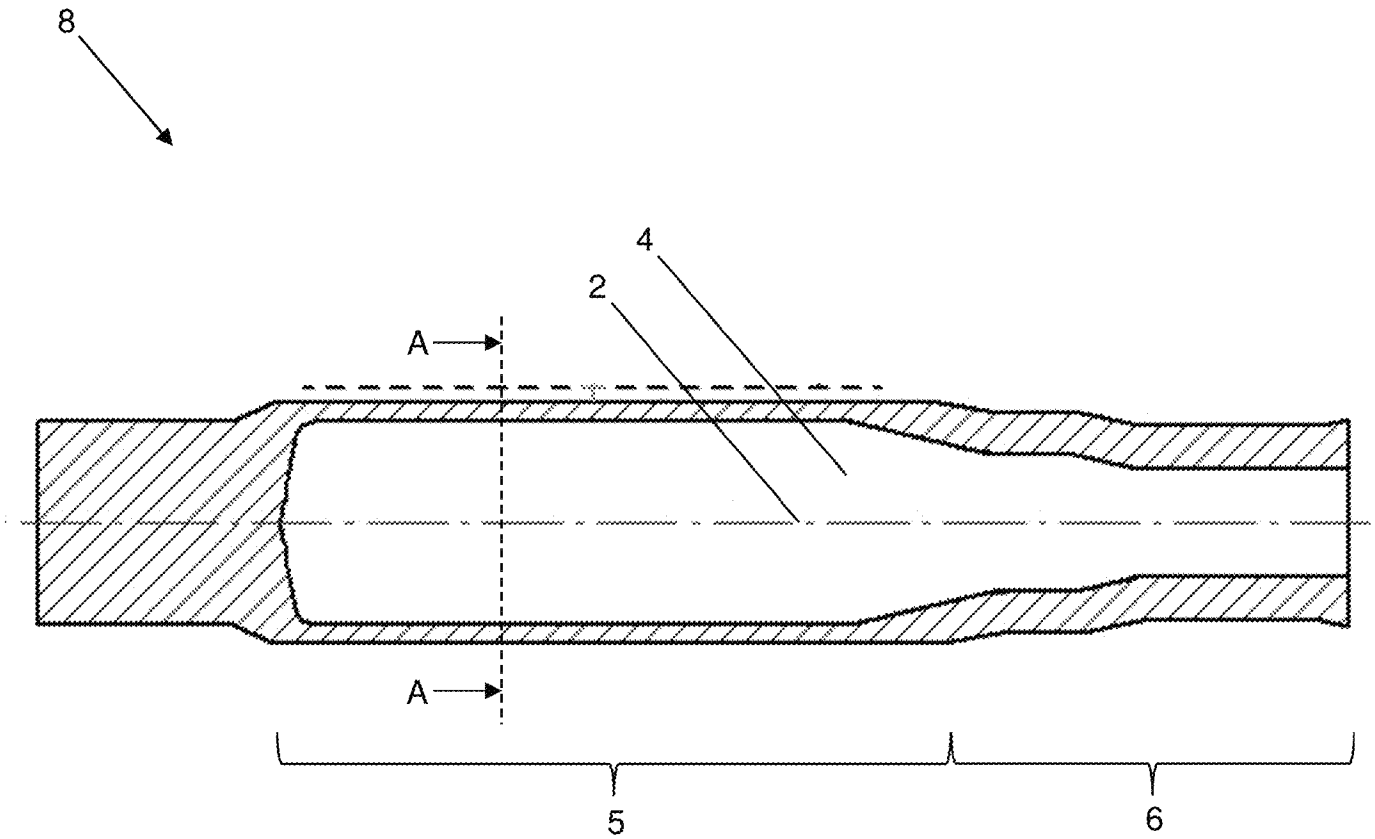
FIG. 3 shows a schematic illustration of an exemplary shaft after a first and a second forging process and a final forging process in which the blank was not rotated.
Figure 4:
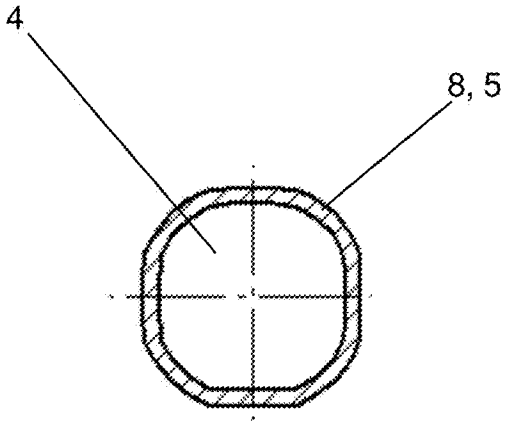
FIG. 4 shows a cross-sectional illustration along the section plane A-A taken from FIG. 3.
Figure 5:
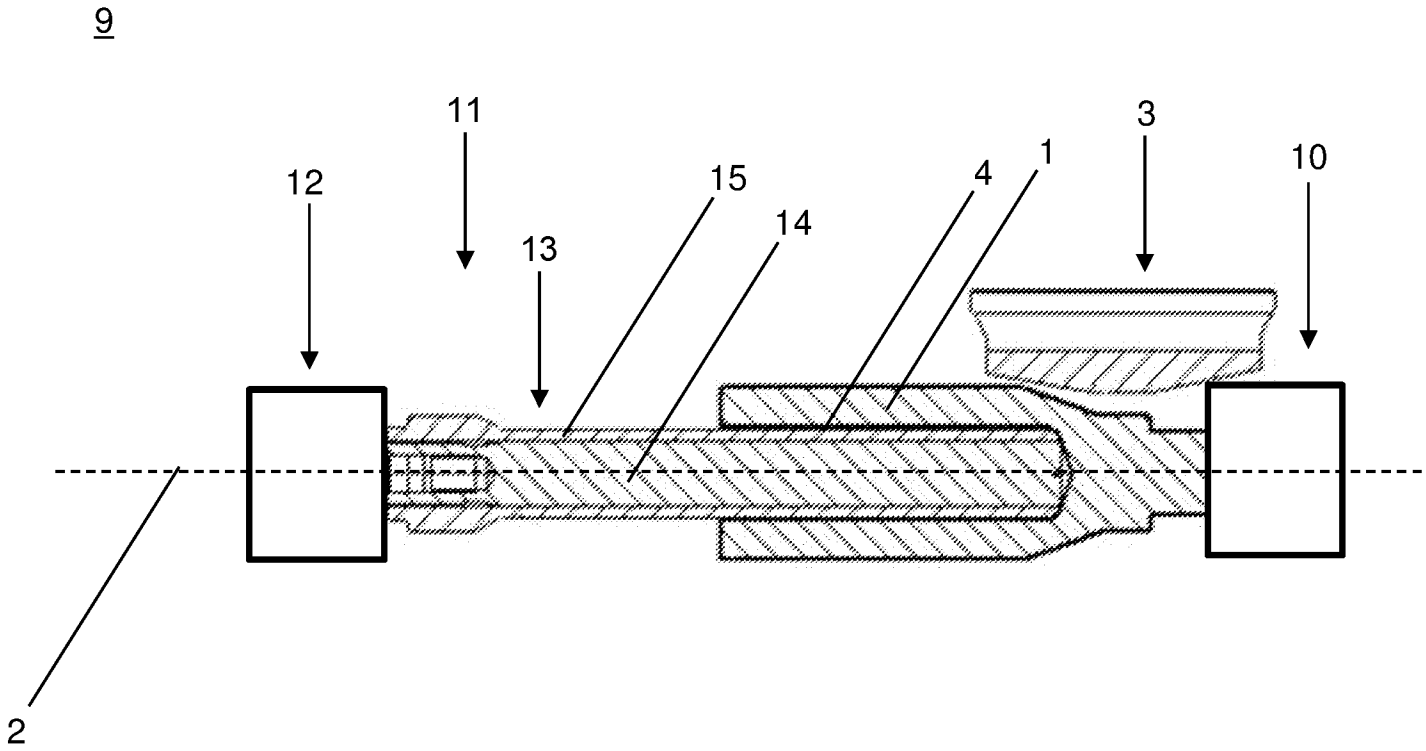
FIG. 5 shows a schematic sectional view of an exemplary forging device in a starting position.
Figure 6:
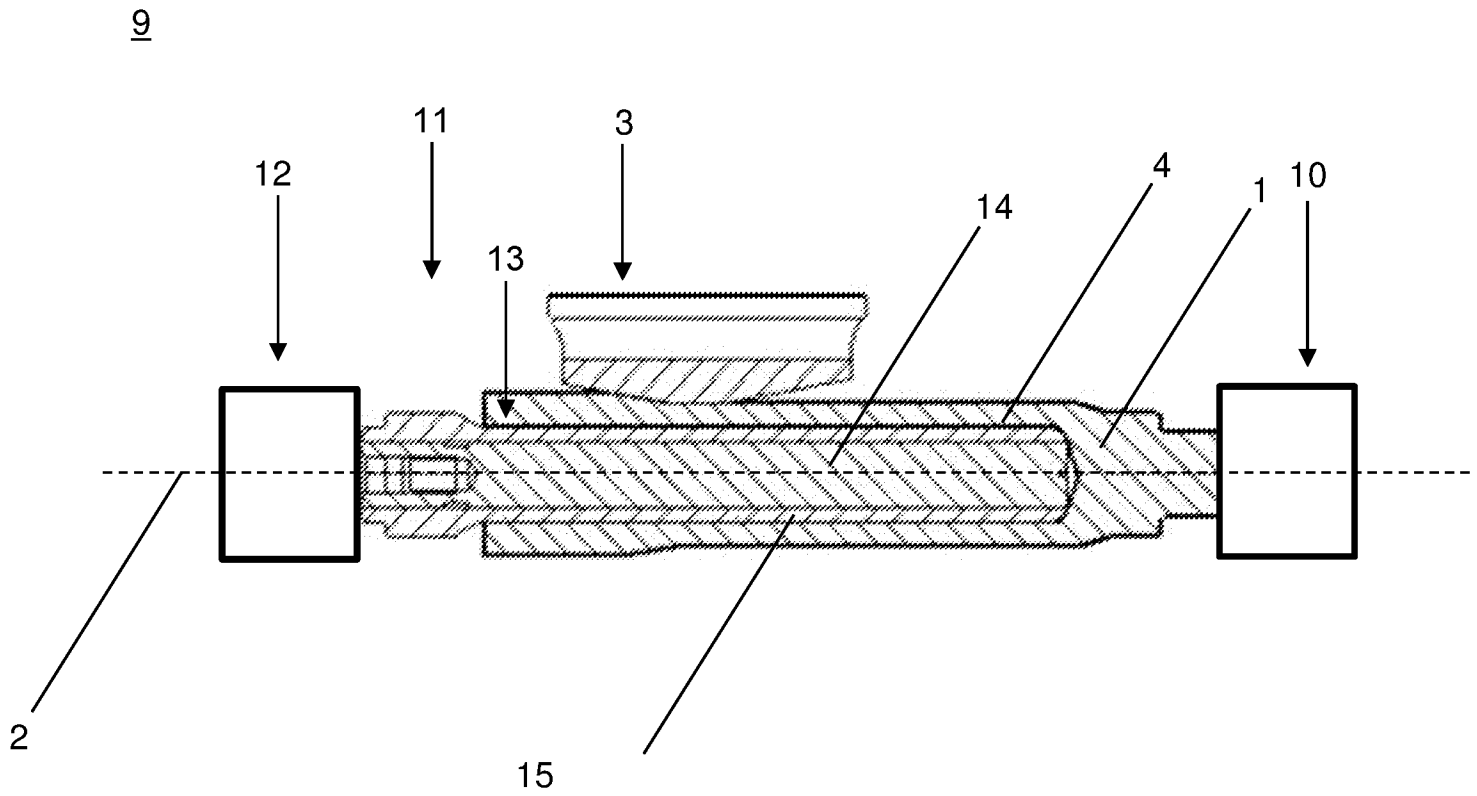
FIG. 6 shows a schematic sectional view of an exemplary device during a first forging process.
Figure 7:
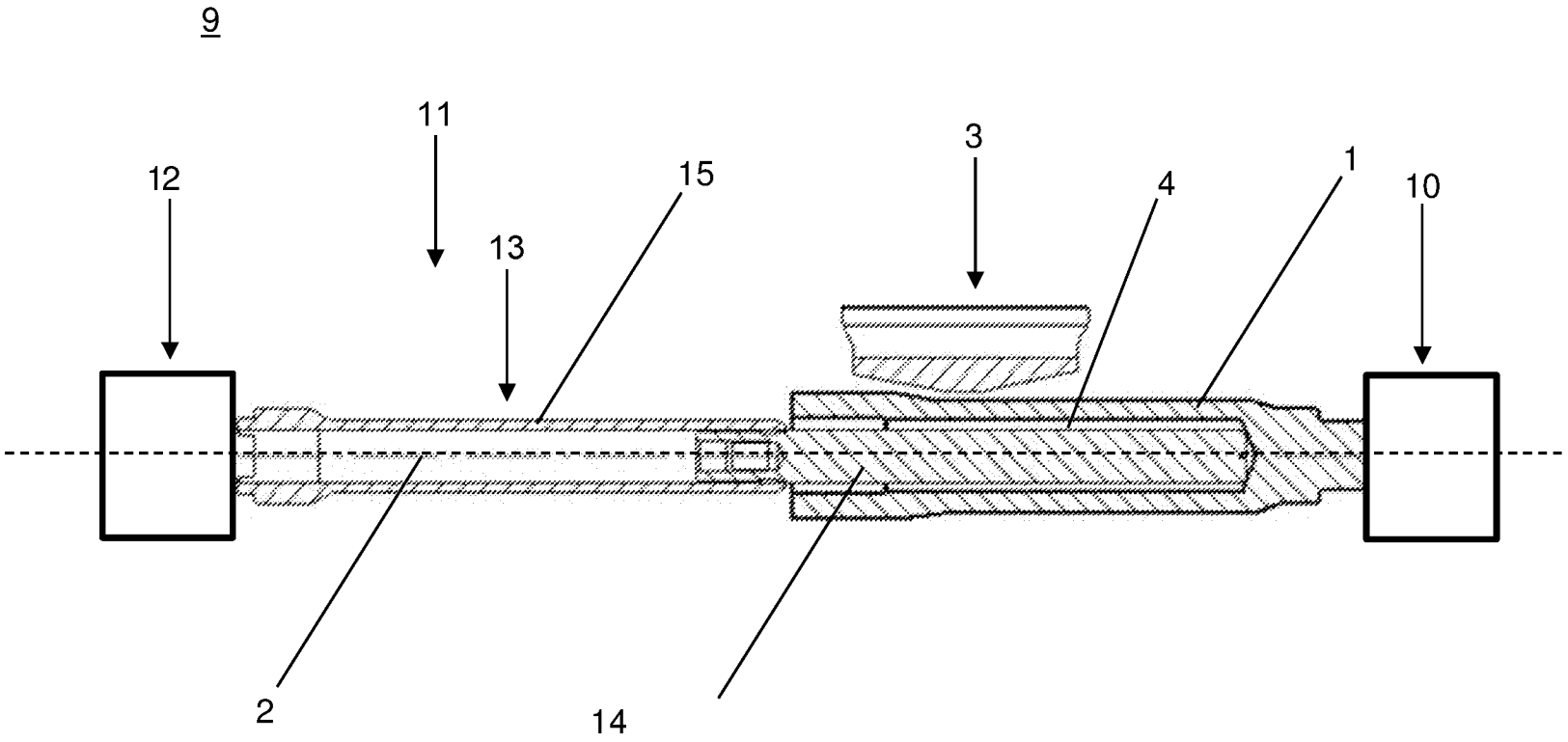
FIG. 7 shows a schematic sectional view of an exemplary forging device between the first forging process and the second forging process.
Figure 8:
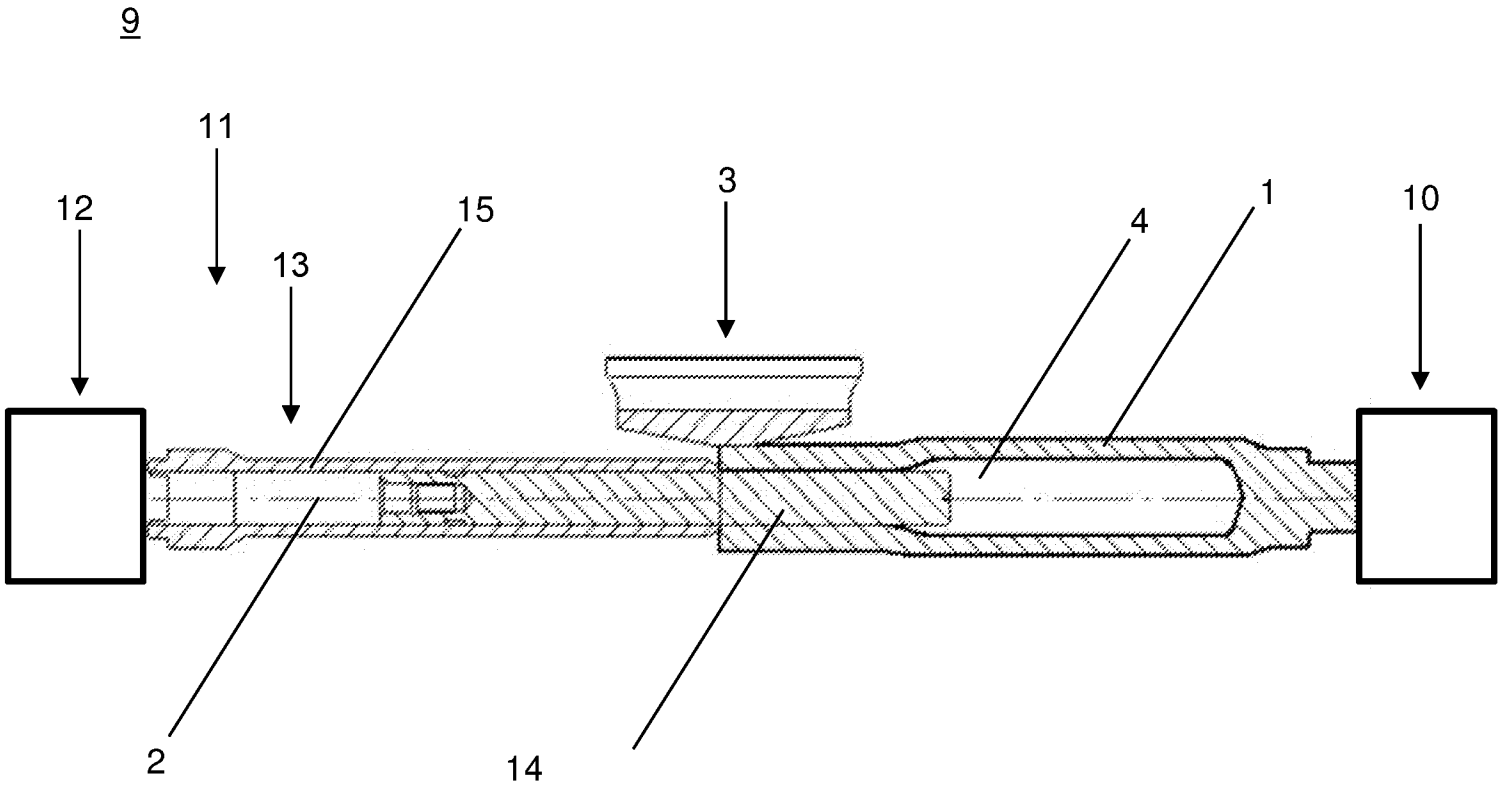
FIG. 8 shows a schematic sectional view of an exemplary forging device during a second forging process.
Figure 9:
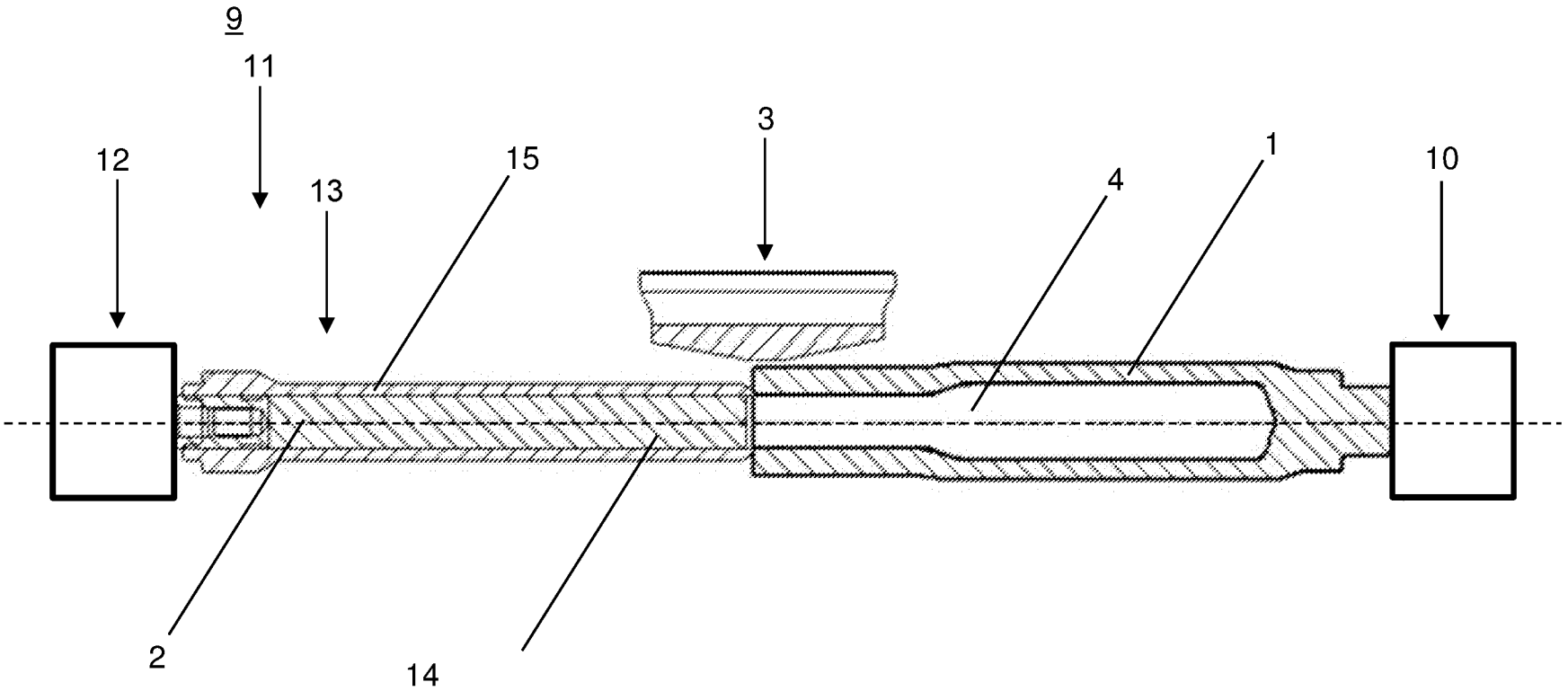
FIG. 9 shows a schematic sectional view of an exemplary forging device after a first and a second forging process.
Figure 10:
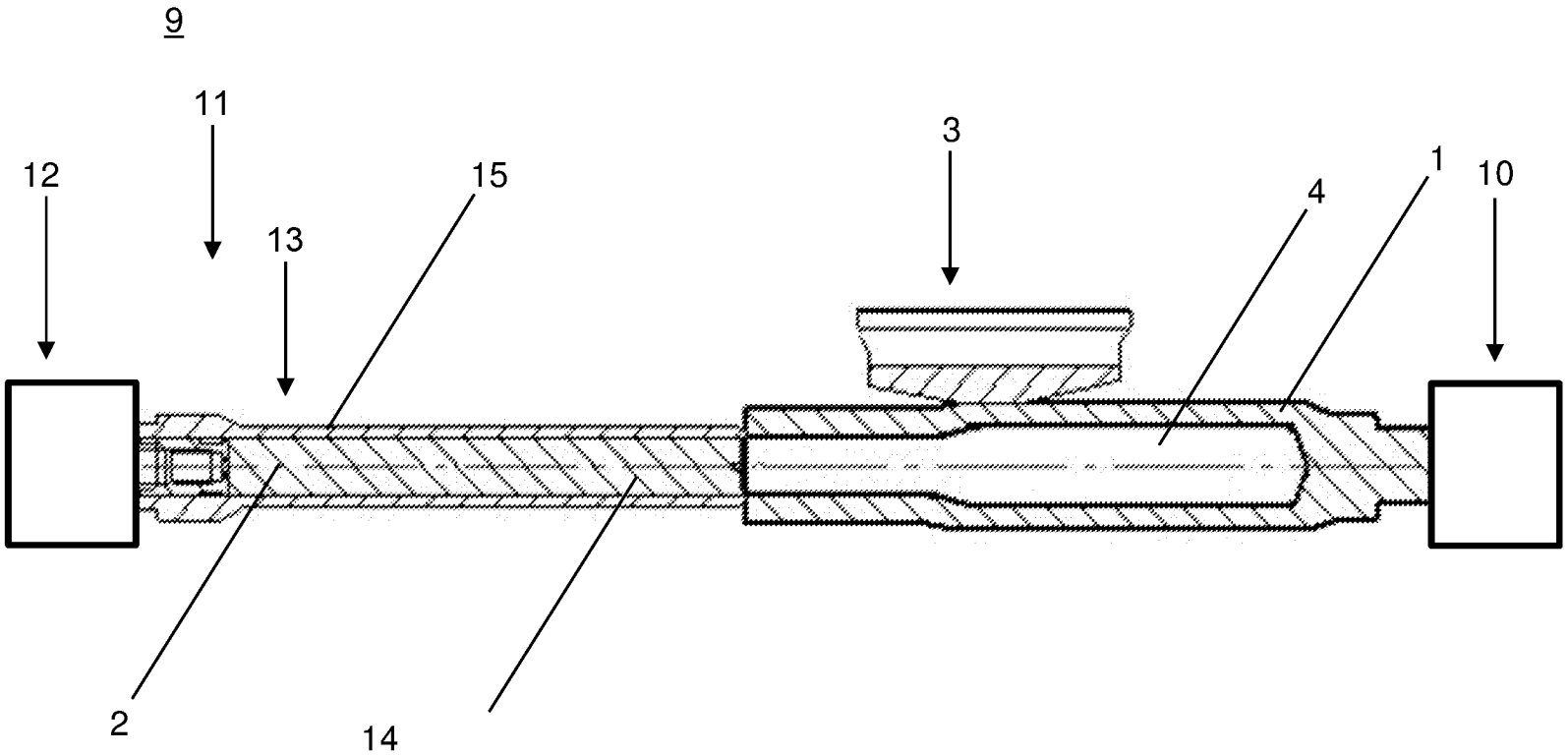
FIG. 10 shows a schematic sectional view of an exemplary forging device during a final forging process in which the blank is not rotated.

FIG. 1 shows a blank 1 before radial forging processes, and FIG. 2 shows a blank 1 after a first forging process and a second forging process. FIG. 3 and FIG. 4 show the finished shaft 8 which is partially polygonal on the outer periphery, i.e. a shaft 8 which is partially not circular in cross-section.

The blank 1 constitutes the starting material for production of the shaft 8. The shaft 8 shown in FIG. 3 has a first shaft portion 5 with a first inner diameter i1 and a first outer diameter a1, and a second shaft portion 6 with a second inner diameter i2 and a second outer diameter a2. The blank 1 is cylindrical, partially hollow with a central cavity 4. In the present exemplary embodiment, the blank 1 is an extruded blank closed at one end. The blank 1 is thus closed at a first end face and open at a second end face opposite this first end face, wherein the opening at the second end face is part of the central cavity 4 of the blank 1.

Figure 11:
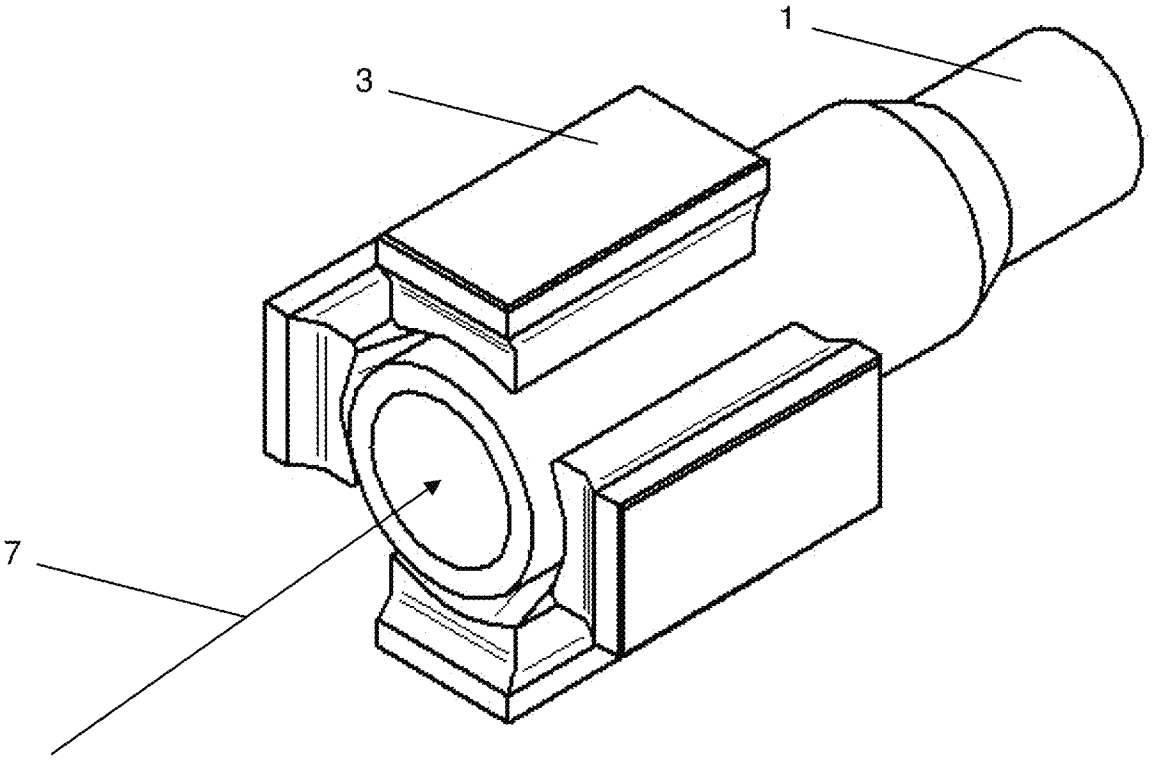
FIG. 11 shows a perspective view of a blank and the forging tools.
Figure 12:
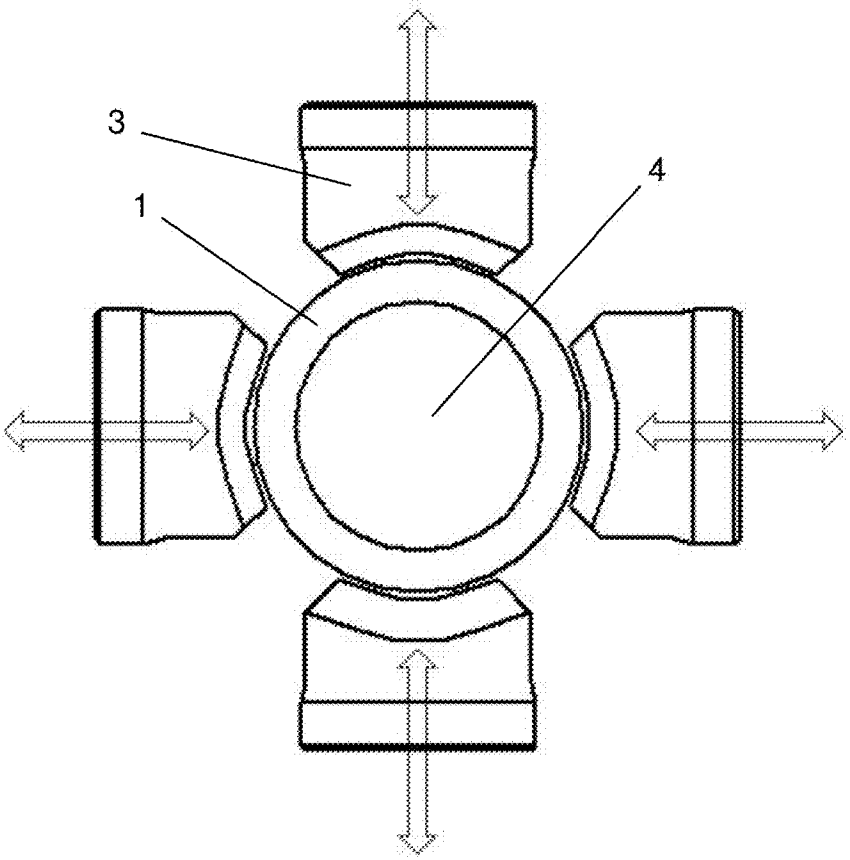
FIG. 12 shows a front view from FIG. 5 viewed in the direction of arrow 7.

A radial forging device 8, depicted schematically in FIG. 5 to FIG. 10, for producing the shaft 8 which is partially polygonal on the outer periphery, comprises four forging tools which are arranged centrally symmetrically about a forging axis 2 and able to be driven in the sense of radial working strokes, namely forging hammers 3. These forging hammers 3 and their arrangement relative to the blank 1 are illustrated in particular in FIG. 11 and FIG. 12. The radial forging device 9 furthermore comprises a forging mandrel which is situated at least partially in the cavity 4 of the blank 1 during a forging process (not shown).

The radial forging device 9 furthermore comprises a clamping head 10 for holding the blank 1, wherein the closed end face of the blank 1 is held at the clamping head 10. The radial forging device 9 also comprises a counterhold 11 for axial support of the blank 1. Thus during the forging process or the individual forging processes, the blank 1 is held between the clamping head 10 and the counterhold 11.

The counterhold 11 has a base 12 and a counterhold mandrel 13 arranged on the base 12. The counterhold mandrel 13 is configured such that it can extend axially partially into the central cavity 4 of the blank 1.

The counterhold mandrel 13 is formed in two pieces, wherein a first part of the counterhold mandrel 13 constitutes an inner part 14, and a second part of the counterhold mandrel 13 constitutes an outer part 15 surrounding the inner part 14.

The outer part 15 is configured so as to be axially movable relative to the inner part 14.

The inner part 14 has an outer diameter which is smaller than that of the outer part 15. The outer part 15 thus has an outer diameter which is larger than that of the inner part 14.

The counterhold mandrel 13 of the counterhold 11 has a greater axial extent than the central cavity 4 of the blank 1.

The directional term "axial" in this context means a direction along or parallel to the forging axis 2. The directional term "radial" in this context means a direction normal to the forging axis 2.

The counterhold, the clamping head and the forging mandrel of the radial forging device are axially movable along a guide bed. The forging hammers 3 of the radial forging device are radially movable.

The method of producing the shaft 8 which is partially polygonal on the outer periphery, as shown in FIG. 3, by means of radial forging comprises the following steps:

- provision of a cylindrical blank 1 with a passage opening at least partially penetrating this blank 1 and forming the central cavity 4 of the blank 1 (extruded blank closed at one end, FIG. 1),
- clamping of the blank 1 in the clamping head 10 of the radial forging device 9 so that an opening of the central cavity 4 lies on an end face of the blank 1 facing away from the clamping head 10 (FIG. 5),
- axial movement of the clamping head 10 with the clamped blank 1 to a first portion of the blank 1 (FIG. 5), axial advance of a counterhold 11 so that a counterhold mandrel 13, namely an inner part 14 and an outer part 15 of the counterhold mandrel 13, axially completely penetrates the central cavity 4 of the blank 1 up to a defined stop, wherein the blank 1 is preloaded via the outer part 15 (FIG. 5),
- radial advance of the forging hammers 3 to the first portion of the blank 1 (FIG. 5, FIG. 6),
- round forging of the first portion of the blank 1 into a first shaft portion 5 with a first inner diameter i1 and a first outer diameter a1, wherein the blank 1 rotates (FIG. 6),
- radial release of the first shaft portion 5 by the forging hammers 3 (FIG. 7),
- axial movement of the outer part 15 of the counterhold mandrel 13 in the direction towards the base 12 of the counterhold 11 out of the central cavity 4 of the blank 1, wherein the end face of the blank 1 is preloaded via the outer part 15 (FIG. 7),
- axial movement of the clamping head 10 with the clamped blank 1 to a second portion of the blank 1 so that an inner part 14 lies in the region of the second portion and only partially penetrates the cavity 4 (FIG. 8),
- radial advance of the forging hammers 3 to the second portion of the blank 1 (FIG. 8),
- round forging of the second portion of the blank 1 into a second shaft portion 6 with a second inner diameter i2 and a second outer diameter a2, wherein the blank 1 rotates (FIG. 8),
- radial release of the second shaft portion 6 by the forging hammers 3 (FIG. 9),
- axial movement of the inner part 14 in the direction towards the base 12 of the counterhold 11 out of the central cavity 4 of the blank 1, wherein the end face of the blank 1 is still preloaded via the outer part 15 (FIG. 9),
- axial movement of the clamping head 10 and counterhold 11 with the clamped blank 1 to the first shaft portion 5 (FIG. 10),
- radial advance of the forging hammers 3 to the first shaft portion 5,
- polygonal forging of the first shaft portion 5, wherein the blank 1 is not subjected to a rotation speed, i.e. does not rotate (FIG. 10),
- radial release of the first shaft portion 5 by the forging hammers 3.

In the present exemplary embodiment, the round forging of the second portion of the blank 1 takes place in one and the same radial forging device 9 as the round forging of the first portion, wherein for this the radial forging device 9 has a specially designed counterhold 11 or counterhold mandrel 13. Forging of the second portion in a separate radial forging device is however also conceivable.

What is claimed is:

1. A method for producing a shaft, which is at least partially not circular in cross-section, from a substantially cylindrical blank; the method comprising the steps of:

in a first radial forging process, radially advancing forging hammers of a radial forging device into contact with a first portion of the blank, rotating the blank, and round forging the first shaft portion with the forging hammers;

in a second radial forging process, radially advancing the forging hammers into contact with a second shaft portion, rotating the blank, and round forging the second shaft portion with the forging hammers; and in an additional final radial forging process, holding the blank rotationally fixed wherein the blank is not rotated and polygonal forging a final shaft portion with the forging hammers to define a non-round profile at the final shaft portion.

2. The method of claim 1, wherein the final shaft portion is part of the first shaft portion.

3. The method of claim 1, wherein the method includes supporting the shaft with a counterhold, wherein the counterhold includes a counterhold base and a counterhold mandrel axially moveable relative to the counterhold base and into a central cavity of the blank, wherein the counterhold mandrel includes in an inner part and an outer part, wherein the inner and outer parts are axially moveable relative to each other.

4. The method of claim 3, wherein, in the first radial forging process, the method includes axially moving the counterhold mandrel including the inner and outer parts into a first position within the central cavity of the blank and the first shaft portion.

5. The method of claim 4, wherein the first radial forging process creates an inner diameter and an outer diameter of the first shaft portion, wherein the inner diameter and the outer diameter correspond to the outer part of the counterhold mandrel and the radial position of the forging hammers, respectively.

6. The method of claim 4, wherein in the second radial forging process, the method includes axially moving the counterhold into a second position, including retracting the outer part out of the central cavity and axially retracting the inner part relative to the first position.

7. The method of claim 6, wherein the first radial forging process creates an inner diameter and an outer diameter of the first shaft portion corresponding to the outer part of the counterhold mandrel and the radial position of the forging hammers in the first radial forging process, respectively, and wherein the second radial forging process creates an inner diameter and an outer diameter of the second shaft portion corresponding to the inner part of the counterhold mandrel and the radial position of the forging hammers in the second radial forging process.

8. The method of claim 7, the method further includes engaging an end face of the blank and axially preloading the blank with the outer part of the counterhold mandrel prior to the final radial forging process.

9. The method of claim 8, wherein the axial preloading occurs after the second radial forging process.

10. The method of claim 3, wherein the method includes clamping an end of the blank with a clamping head and supporting the blank with the counterhold, wherein the counterhold and the clamping head are axially moveable along a guide bed, wherein the forging hammers are radially moveable.

11. The method of claim 3, wherein the counterhold mandrel is configured to radially and axially support the blank, wherein the counterhold mandrel fully penetrates the central cavity and in contact with an end of the central cavity during the first radial forging process, wherein the counterhold mandrel partially penetrates the central cavity during the second radial forging process, wherein the counterhold mandrel is fully retracted from the central cavity and axially preloads an end face of the blank during the final radial forging process.

12. A method for producing a shaft, which is partially polygonal on the outer periphery, by radial forging, the method comprising the steps of:

providing a cylindrical blank, wherein the blank includes a passage opening at least partially penetrating the blank and forming a central cavity of the blank;

clamping the blank in a clamping head of a radial forging device, wherein an opening of the central cavity of the blank is disposed on an end face of the blank facing away from the clamping head;

axially moving the clamping head with the clamped blank relative to forging hammers and positioning the forging hammers axially at a first portion of the blank;

axially advancing a counterhold relative to the clamped blank, wherein the counterhold includes a counterhold base and a counterhold mandrel, wherein the counterhold mandrel includes an inner part and an outer part, wherein the counter mandrel penetrates the central cavity of the blank up to a defined stop and supports the clamed blank;

radially advancing the forging hammers into contact with the blank along the first portion of the blank;

rotating the blank and round forging the first portion of the blank in a first round forging step into a first shaft portion with a first inner diameter and a first outer diameter via the radially advanced forging hammers;

radially releasing the first shaft portion from the forging hammers;

axially moving the outer part of the counterhold mandrel in a direction toward the counterhold base and away from the clamping head out of the central cavity of the blank;

axially moving the clamping head with the clamped blank relative to the forging hammers and positioning the forging hammers axially at a second portion of the blank, wherein the inner part of the counterhold mandrel lies along the second portion;

radially advancing the forging hammers into contact with the second portion of the blank;

rotating the blank and round forging the second portion of the blank in a second round forging process into a second shaft portion with a second inner diameter and a second outer diameter;

radially releasing the second shaft portion from the forging hammers, axially moving the inner part of the counterhold mandrel in the direction away from the clamping head and out of the central cavity of the blank;

axially moving the counterhold and the clamping head with the clamped blank relative to the forging hammers and aligning the forging hammers at the first shaft portion;

radially advancing the forging hammers into contact with the first shaft portion, rotationally fixing the blank and performing polygonal forging on the first shaft potion, wherein the blank does not rotate during the polygonal forging; and radially releasing the first shaft the first shaft portion form the forging hammers.

13. The method of claim 12, wherein the blank is an extruded blank having two ends, and the blank is closed at one end.

14. The method of claim 12, wherein, in the first radial forging process, the counterhold mandrel fully penetrates the central cavity and the outer part of the mandrel supports the blank.

15. The method of claim 14, wherein, in the second radial forging process, the counterhold mandrel partially penetrates the central cavity and the inner part of the mandrel supports the blank.

16. The method of claim 15, wherein the first inner diameter of the first shaft portion corresponds to the outer part of the counterhold mandrel, wherein the first outer diameter corresponds to the positioning of the forging hammers in the first round forging step.

17. The method of claim 16, wherein the second inner diameter of the second shaft portion corresponds to the inner part of the counterhold mandrel and the second outer diameter corresponds to the positioning of the forging hammers in the second round forging step.

18. The method of claim 12 further comprising preloading the end face of the blank with the outer part of the counterhold mandrel at least during the polygonal forging step.

19. The method of claim 18, wherein the preloading occurs prior to moving the inner part out of the central cavity.

20. The method of claim 18, wherein the preloading occurs after the second round forging process.

* * * * *